United States Patent [19]

Rubnerth

[11] Patent Number: 4,648,573

[45] Date of Patent: Mar. 10, 1987

[54] COLLAPSIBLE AWNING SUPPORT FRAME

[76] Inventor: Oscar R. Rubnerth, 17887 San Clemente St., Fountain Valley, Calif. 92708

[21] Appl. No.: 794,511

[22] Filed: Nov. 4, 1985

[51] Int. Cl.[4] ..... A47H 1/10

[52] U.S. Cl. ..... 248/273; 160/45; 160/76

[58] Field of Search ..... 160/19, 20, 65, 76, 160/77, 81; 248/273; 403/232.1, 230, 245, 353, 405.1, 406.1

[56] References Cited

U.S. PATENT DOCUMENTS

| | | | |
|---|---|---|---|
| 781,588 | 1/1905 | Branch et al. | 160/76 |
| 798,369 | 8/1905 | Stutenroth | 160/77 |
| 2,136,012 | 11/1938 | Jones | 160/20 |
| 2,373,574 | 4/1945 | Larson | 248/273 |
| 2,469,020 | 5/1949 | Thomson | 160/81 |
| 2,583,663 | 1/1952 | Obenchain | 160/76 |
| 3,356,329 | 12/1967 | Santo | 248/273 |
| 3,762,749 | 10/1973 | Pansini | 403/341 |

*Primary Examiner*—Richard J. Scanlan, Jr.
*Assistant Examiner*—Anthony Knight
*Attorney, Agent, or Firm*—William L. Chapin

[57] ABSTRACT

A collapsible awning support frame includes an elongated, horizontal thrust bar fastenable by a lower mounting bracket to the vertical wall of a structure and extending outwards therefrom, and an elongated tension bar pivotably fastened to the thrust bar near the outer, free end of the thrust bar and extending upwards and backwards towards an upper mounting bracket. The upper mounting bracket, intended for fastening to the wall of the structure above and in vertical alignment with the thrust bar mounting bracket, has a hook pin extending upward and outward from the base of the bracket, for pivotably engaging a hole in the bottom wall of the tension bar, near the upper end of the tension bar. Upward movement of the tension bar is restricted by contact with a tab that extends downward from a roof section of the bracket which extends outward from the structure wall. Unfastening the inner end of the thrust bar from the wall mounting bracket permits the tension bar to hang suspended downwards from the hook pin in a collapsed position. Lifting the tension bar up and pivoting it backwards permits demounting the frame entirely from the structure.

9 Claims, 6 Drawing Figures

FIG. 1
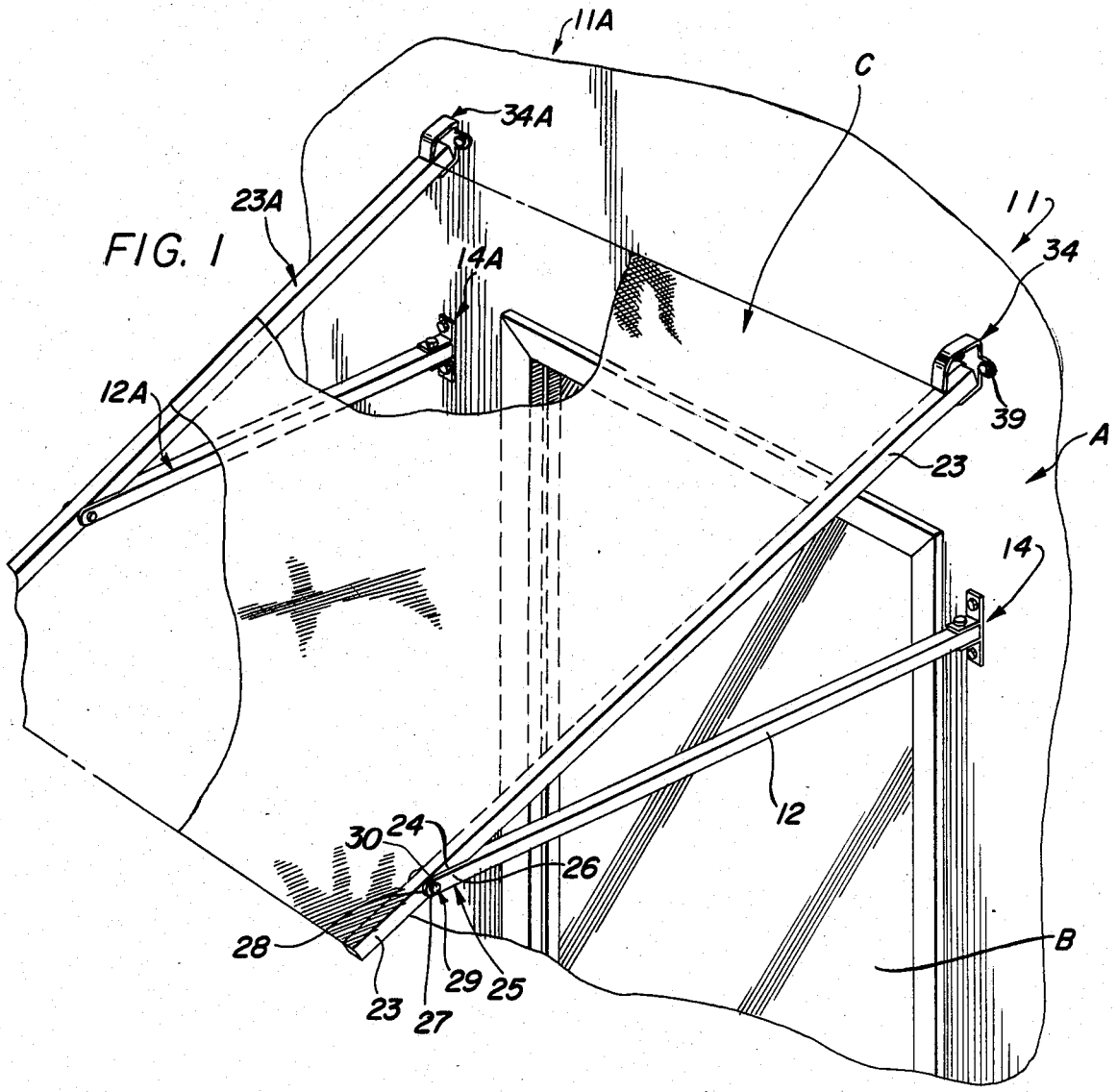
FIG. 3
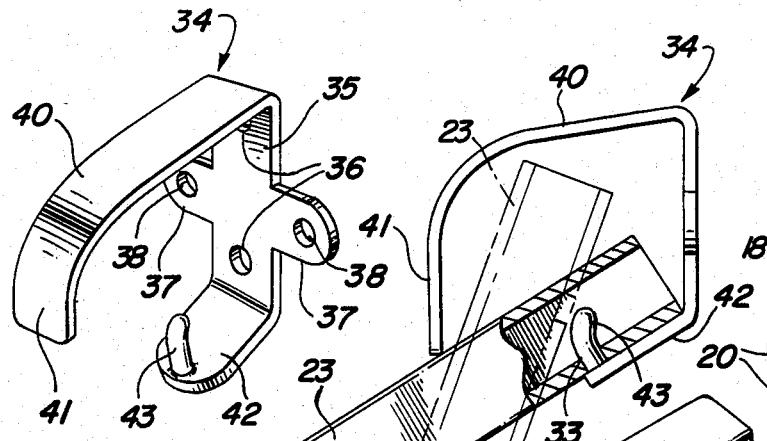
FIG. 4
FIG. 2
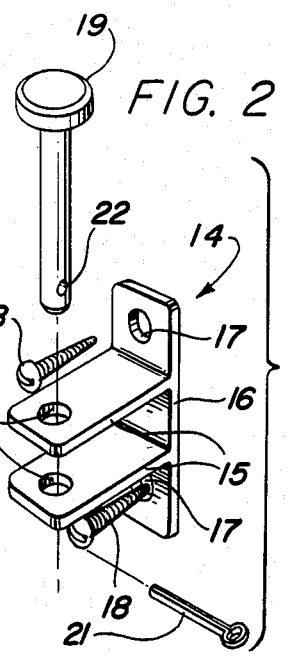

COLLAPSIBLE AWNING SUPPORT FRAME

BACKGROUND OF THE INVENTION

1. Field of the Invention

This invention relates to frames for supporting flexible or rigid awning material to form a canopy extending outward from the wall of a structure. More particularly, the invention relates to awning support frames which may be collapsed into a position substantially flush with the wall of the supporting structure.

2. Description of Background Art

Awnings are used extensively on buildings to shield windows or entranceways from rain and snow, and from strong rays of the sun when it is high overhead. Commercial and public buildings frequently are provided with awnings which serve decorative purposes, as well as performing the protective functions described above.

In the event of a fire or other emergency requiring fireman to ascend ladders placed against the outside wall of a building, awnings extending outward from the building wall present an obstacle to the operations of the fireman. Recognizing this problem, many local governmental bodies have enacted codes requiring that awnings installed on certain classes of buildings be readily collapsible.

One such collapsible awning support is disclosed by Santo in U.S. Pat. No. 3,356,329, dated Dec. 5, 1967. Santo discloses an adjustable awning support in which the canopy portion of the awning assembly is pivotably fastened along its upper lateral edge to an upper support bracket attached to an outer wall of a building. The lower portion of the canopy portion is held outward from the building by a pair of tubular support arms, one on each side of the canopy, pivotably fastened to the wall at their inner ends, and to the sides of the canopy at their outer ends. Means are provided to adjust the length of the tubular support arms, and therefore, of the inclination of the canopy relative to the wall. When the support arms are adjusted to their shortest length, the lower surface of the canopy lies in flush contact with the building wall. Thus the range of adjustability of the awning support disclosed by Santo includes a collapsed position.

The adjustable awning support frame disclosed by Santo appears well suited to its intended function. However, it would be desirable to provide an awning support frame that fulfilled the requirement for an awning frame which was collapsible, yet not incorporating adjustability features which might increase the cost, weight or complexity of the support frame. With that goal in mind the collapsible awning support frame according to the present invention was conceived of.

OBJECTS OF THE INVENTION

An object of the present invention is to provide an awning support frame which may be readily collapsed from a normal position extending outward from a wall of a building to an alternate position substantially flush with the wall of the building.

Another object of the invention is to provide a collapsible support frame having support members for awning cover material which may be readily mounted and demounted from wall brackets comprising part of the invention.

Another object of the invention is to provide a novel upper support bracket for the angled upper tension member of an awning support frame to which the member may be readily mounted to, demounted from or collapsed with respect to the building wall on which the bracket is mounted, by an individual situated below the bracket.

Various other objects and advantages of the present invention, and its most novel features, will become apparent to those skilled in the art by reading the accompanying specifications and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiments described. I do intend that reasonable equivalents, adaptations and modifications of the invention described herein be included within the scope of the invention as defined by the appended claims.

SUMMARY OF THE INVENTION

Briefly stated, the present invention comprehends a frame fastenable to the wall of a building for supporting awnings adjacent the wall. The support frame according to the present invention, includes a straight, elongated, horizontal thrust member extending perpendicularly outward from a lower support bracket fastened to the wall of a building.

The support frame also includes a straight, elongated, hollow tension member pivotably fastened near its outer end to the outer end of the thrust member.

The tension member extends inward and upward towards the wall of the building, where the free end of the tension member is secured to the wall by an upper bracket. Thus, in side view the support frame according to the present invention has the shape of a right triangle; the lower thrust member forming the vertical leg or altitude of the triangle, the upper tension member forming the hypotenuse, and a vertical line joining the upper and lower brackets forming the base.

Two awning support frames of the type described are fastened at equal heights to laterally spaced apart points of the building wall to provide a mounting base for a laterally disposed awning canopy.

A plurality novel and useful component of the collapsible awning support frame according to the present invention is the upper support bracket used to hold the upper end of the tension member next to the wall of the building. The upper support bracket has the general appearance of a flat metal strip of uniform width and thickness which is bent into a four-sided, open figure having a gap between two adjacent sides, as viewed parallel to the thickness dimension of the strip, which thickness dimension is substantially less than the width of the strip.

The base portion of the bracket strip is flat, and secured in a vertical position flush with the wall of a building by bolts passing through mounting holes provided through the thickness dimension of the base.

An upper, or roof portion, of the upper support bracket strip bends downward and outward at an acute angle from the upper end of the base portion of the strip. This detail portion of the strip, including the roof section, bends downward arcuately to form a vertical, downwardly disposed tab.

The lower end of the base portion of the upper support bracket strip bends outward and downward at an obtuse angle to form a floor section. The length of the floor section is substantially less than the length of the roof section, providing a large open space between the outer, free edge of the floor section and the lower free edge of the downwardly disposed tab.

A curved, uniform diameter hook pin extends perpendicularly upward, then backwards from the upper surface of the floor section. The pin is positioned along the longitudinal center line of the floor section, near the outer, free transverse edge of the floor section.

The upper end of the tension member forming part of the support frame contains a hole bored perpendicularly through the lower wall of the member, near the upper edge of the member.

Mounting the tension member to the upper support bracket is accomplished by first inserting the upper end of the member diagonally upwards through the opening provided between the floor section and tab of the bracket. The upper end of the tension member is then tilted backwards until the hook pin engages the hole in the bottom surface of the tension member.

BRIEF DESCRIPTION OF THE DRAWINGS

FIG. 1 is a perspective view of two collapsible awning support frames according to the present invention installed in laterally spaced apart positions on the wall of a building and supporting an awning canopy of the upper surfaces of the frames.

FIG. 2 is a fragmentary perspective view of the support frame shown in FIG. 1, showing the lower support bracket forming part of the support frame.

FIG. 3 is an enlarged perspective view of the upper support bracket forming part of the support frame shown in FIG. 1.

FIG. 4 is a fragmentary, partially sectional side elevation view of the support frame shown in FIG. 1.

DESCRIPTION OF THE PREFERRED EMBODIMENT

Figure 5:
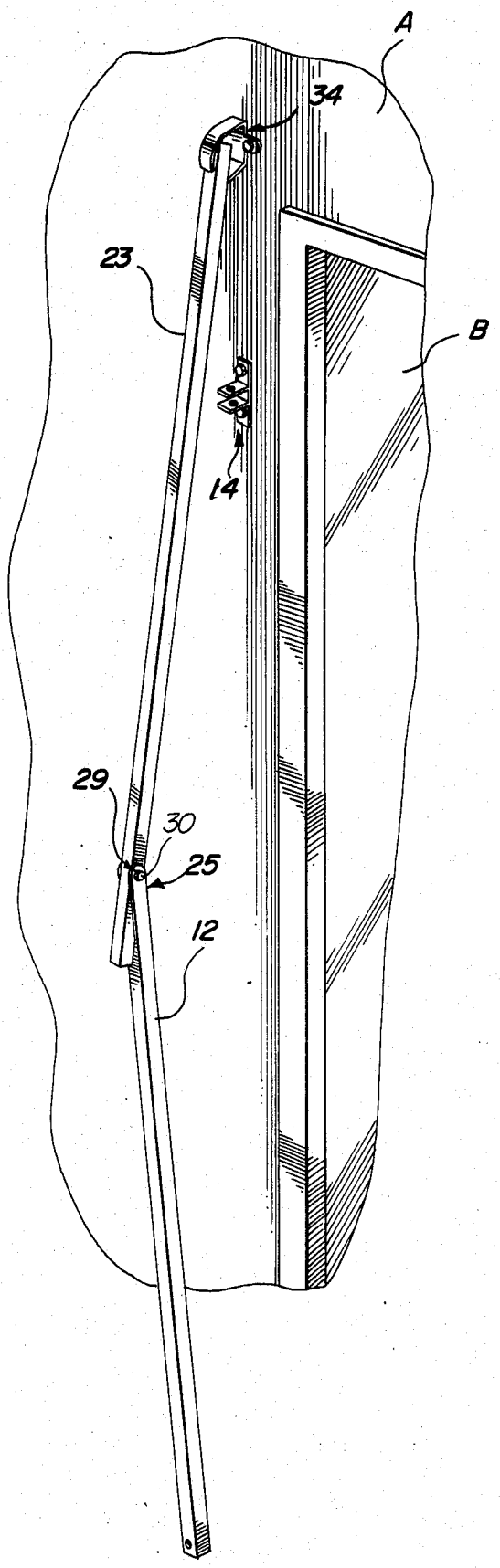
FIG. 5 is a perspective view showing the support frame of FIG. 1 in a collapsed position.

Referring now to FIG. 1, two identical collapsible awning support frames 11 and 11A, according to the present invention, are shown at laterally spaced apart positions to the vertical wall A of a building on either side of a window B. As shown in FIG. 1, each support frame 11 is identical, and includes an elongated, uniform transverse cross section thrust bar 12.

As shown, thrust bar 12 is fabricated from a hollow steel tube having a rectangular transverse cross-sectional shape. Thrust bar 12 could also have other cross-sectional shapes, including primarily a circular cross-section. One end of thrust bar 12 is provided with registered holes 13 passing through the upper and lower walls of the thrust bar.

Thrust bar 12 is supported in a horizontal position, disposed perpendicularly outwards from building wall A, by means of lower support bracket 14.

As may be seen best by referring to FIGS. 1 and 2, lower support bracket 14 has the general shape of a clevis having opposed parallel channel plates 15 extending perpendicularly outward from a flat, rectangular base plate 16. Base plate 16 of lower support bracket 14 is provided with two holes 17 passing through the thickness dimension of the base plate, in symmetrical positions on the outside of either channel plate 15. Lower support bracket 14 is fastened to vertical building wall A by means of bolts 18 passing through holes 17 in base plate 16 of the bracket and into the wall.

Thrust bar 12 is fastened to lower support bracket 14 by first inserting that end of the thrust bar containing holes 13 between clevis channel plates 15. Then a clevis pin 19 is inserted downwards through registered holes 20 passing through the thickness dimension of clevis channel plates 15, and through the registered holes 13 through the upper and lower walls of the thrust bar. Clevis pin 19 is secured in position by means of a cotter pin 21 inserted through a transverse hole 22 bored through the shank of clevis pin 19, near its outer end.

As shown in FIG. 1, the collapsible awning support frame according to the present invention also includes an elongated tension member or bar 23. Tension bar 23 is fabricated from a hollow steel tube. As shown, tension bar 23 has a rectangular transverse cross-sectional shape, although it could also have a circular cross-sectional shape. In the preferred embodiment, the outer width or "O.D." of tension bar 23 is slightly less than the lateral distance between the inner walls ("I.D.") of thrust bar 12.

Identical rectangular slots 24 extending longitudinally inward from the outer face of thrust bar 12 are cut into the upper and lower walls of the thrust bar. The width of slots 24 is equal to the I.D. of thrust bar 12. Thus, cutting slots 24 leaves a clevis-shaped structure or saddle 25 at the outer end of thrust bar 12 which has parallel, vertically disposed side strips 26 coextensive with the side walls of the thrust bar.

As shown in FIG. 1, tension bar 23 fits between side strips 26 at the end of thrust bar 12. Registered holes 27 in opposite side strips 26 are aligned with registered holes 28 in the side walls of tension bar 23 near its outer end to permit a pivot pin 29 to be passed through all four holes. Pivot pin 29 has an enlarged head 30 and a transverse hole through its shank near the opposite end of the pivot pin. A cotter pin passing through hole is used to secure pivot pin, thrust bar and tension bar pivotably together.

Near the end of tension bar 23 furthest from its attachment point with thrust bar 12, a hole 33 is bored perpendicularly upwards through the lower wall of the tension bar and into its hollow interior. Hole 33 cooperates in fastening the upper, free end of tension bar 11 to building wall A, in a manner to be described later.

FIG. 3, shows an upper mounting bracket 34 which is used to hold the upper end of tension bar 11, and which is a particularly novel and important part of the present invention.

As shown in FIG. 3, the major portion of upper support bracket 34 is fabricated from a thin, flat metal strip of generally uniform width, which has been bent in several places along transverse fold lines. Thus, in edge view, the general appearance of support bracket 34 is that of a four-sided, figure having a gap between two adjacent sides, whose sides intersect at angles defined by the dihedral angles formed between the flat sides of the strip on either side of a bend.

Preferably, upper support bracket 34 is fabricated from a heavy steel strip or angle iron stock.

The base 35 of upper support bracket 34 is a flat, rectangular outline portion of the strip from which the bracket is fabricated. A plurality of mounting holes 36 extends through the strip on its longitudinal center line.

Preferably, base 35 has laterally extending bosses or ears 37 on opposite transverse sides of the base having mounting holes 38 extending through the thickness dimension of the ears. As shown in FIG. 1, mounting bolts 39 passing through holes 36 and/or 38 are used to fasten the upper mounting bracket to wall A of a building, with the flat, under surface base 35 of the bracket in flat, parallel contact with the wall.

As may be seen best by referring to FIGS. 3 and 4, a portion of the strip from which upper mounting bracket 34 is fabricated bends outward and downward at an acute angle from base 35 to form a generally flat upper roof 40. The outer end of the portion of the strip including roof 40 bends arcuately downward from the outer edge of the roof to form a downwardly disposed tab 41. Tab 41 is a generally, flat, vertically disposed portion of the strip from which upper mounting bracket 34 is fabricated.

The lower end of base wall 35 of bracket 34 bends outward and downward at an obtuse angle to form a flat, rectangular outline floor 42. The length of floor 42 is substantially less than the length of roof 40. This results in a large open space between the outer edge of floor 42 and the lower edge of tab 41.

A backwardly curved, uniform diameter hook pin 43 fastened to the floor 42 of upper mounting bracket 34 extends perpendicularly upwards from floor 42, then backwards towards base wall 35. Hook pin 43 is fastened to floor 42 along the longitudinal center line of the floor and strip, near the outer transverse edge of the strip.

Collapsible awning support frame 11 is mounted to building wall A as follows. Referring now to FIG. 1, a lower support bracket 14 is fastened to the building wall A, and an upper mounting bracket 34 fastened higher up on the wall, in vertical alignment with the lower support bracket. Corresponding brackets 14A and 34A are fastened in vertical alignment to building wall A at the same height as bracket 14 and 34, respectively, but at a lateral displacement equal to the desired lateral span of the awning canopy.

The outer portions of thrust bar 12 and tension bar 23 are then fastened together by means of prior pin 29 as has been described above.

Referring next to the phantom view in FIG. 4, the free upper end of tension bar 23 containing hole 33 in its bottom wall is inserted diagonally upwards through the open space between tab 41 and floor 42 of upper mounting bracket 34. The upper end of tension bar 23 is then tilted backwards until hook pin 43 engages hole 33 in the bottom wall of the tension member. With hole 33 and hook pin 43 thus engaged, the awning installer is free to allow tension bar 23 to hang freely down from the hook pin, the backward curving portion of the hook pin preventing the tension bar from disengaging the hook.

The final step in mounting awning support frame 11 to building wall A includes tilting tension bar 23 upwards towards tab 41 of upper mounting bracket 34. The free end of thrust bar 12 is then pivoted laterally between clevis channel plates 15 of lower support bracket 14. Finally, thrust bar 12 is secured to lower support bracket 14 by means of clevis pin 19 and cotter pin 21, in a manner previously described.

Collapsible awning support frame 11A, laterally displaced from frame 11, is mounted to wall A in an exactly analogous fashion to that just described for mounting frame 11, completing installation of the awning.

Downward movement of awning canopy C attached to tension bars 23 and 23A by adhesive bonding, rivets, or any other suitable means is inhibited by resistance to distortion under compressive stress afforded by thrust bars 12 and 12A. Upward movement of awning canopy C, as for example in response to wind updrafts, is inhibited by contact of the upper wall of tension bars 23 and 23A with the lower edges of tabs 41 and 41A of upper mounting brackets 34 and 34A.

An important advantage of the collapsible awning support frame 11 according to the present invention is the ease with which the frame may be collapsed or removed by a single individual locked at street level next to the building on which the frame is mounted. Frame 11 may be collaped by removing clevis pin 19 from lower support bracket 14, pivoting thrust bar 12 laterally outward and away from the bracket, and allowing the freed end of the thrust bar 12 to fall under its own weight towards the ground. This collapsed position of frame 11 is illustrated in FIG. 5. The rapid and simply performed collapsibilty of frame 11 is especially advantageous when a fire or other emergency requires placement of ladders against a building, which action might be otherwise hindered by awnings jutting out from the building.

From the collapsed position shown in FIG. 5, collapsible awning support frames 11 are very easily demounted entirely from building wall A. This may be accomplished by a single individual working at street level, by simply lifting and tilting the upper end of tension bar 23 forward off of hook pin 43 of upper mounting bracket 34, and withdrawing the tension bar from the opening between tab 41 and floor 42 of the bracket. Thus, the mounting, collapsing and demounting of collapsible awning support frame 11, according to the present invention, may all be accomplished without requiring manual contact with upper mounting bracket 34.

Figure 6:
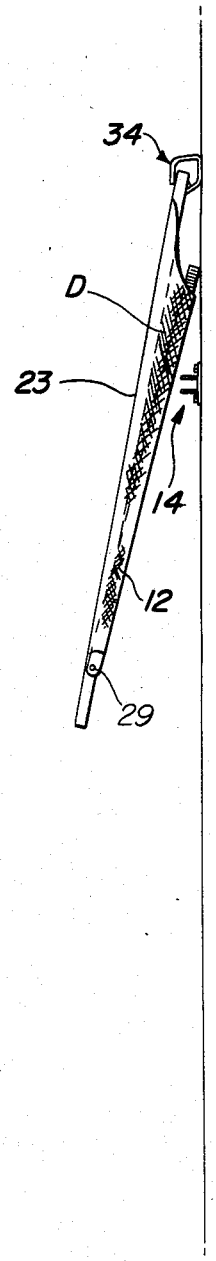
FIG. 6 is a perspective view showing the support frame of FIG. 1 in an alternate collapsed position.

FIG. 6 illustrates an alternate method of collapsing awning support frame 11 when triangular awning fabric panels D are fastened between thrust bar 12 and tension bar 23. In this case, thrust bar 12 is pivoted upwards towards tension bar 23, and the entire assembly is then allowed to hang adjacent to building wall A.

What is claimed is:

1. A collapsible awning support frame comprising;

(a) an elongated rigid thrust member (b) means for fastening a first end of said thrust member to a building wall, (c) an elongated rigid tension member, (d) means for pivotably fastening a first end portion of said tension member to the second end of said thrust member in coplanar alignment therewith, and (e) a bracket for pivotably fastening the second end of said tension member to a building wall above and in vertical alignment with said means for fastening said first end of said thrust member to said building wall, said bracket having means for fastening said bracket to said wall, and an elongated, curved hook pin fastened to said bracket and protruding upward and outward from a vertical plane, and (f) an aperture in the bottom surface of said tension member near said second end of said tension member, whereby said aperture may be engaged by said hook pin, thus supporting said tension member against downward loads.

2. The collapsible awning support frame of claim 1 wherein said bracket comprises;

(a) an essentially flat base wall adapted to flush mounting to a structure wall, (b) an essentially flat floor section extending outward and downward from said base wall, said elongated hook pin being joined perpendicularly to the upper surface of said flat floor section, and having a backwardly and upwardly curved upper section joined to said straight bottom section.

3. The collapsible awning support frame of claim 2 wherein said bracket further comprises means for limiting the degree of upward pivotal motion of said tension bar when said tension bar is engaged by said hook pin.

4. The collapsible awning support frame of claim 3 wherein said means for limiting upward motion of said tension bar is defined as a tab joined to said bracket and extending downwards parallel to and spaced out from said base wall of said bracket.

5. A collapsible awning support frame comprising;

(a) an elongated rigid thrust member, (b) means for fastening a first, inner end of said thrust member to a structure, (c) an elongated rigid tension member, (d) means for pivotably fastening a first end portion of said tension member to a second, outer end of said thrust member in coplanar alignment therewith, and (e) means for pivotably fastening a second end of said tension member to a structure above and in vertical alignment with said means for fastening said first, inner end of said thrust member to said structure, said means for pivotably fastening said second end of said tension member comprising;

(i) a bracket having means for fastening said bracket to said structure, (ii) an elongated curved hook pin fastened to said bracket and protruding upward and outward from a vertical plane, the upper end of said hook pin curving upward and inward, and (iii) an aperture in the bottom surface of said tension member near said second end of said tension member, whereby said aperture may be engaged by said hook pin, thus supporting said tension member against downward loads.

6. The collapsible awning support frame of claim 5 wherein said bracket is further defined as comprising;

(a) a base section having means for fastening said base section to a structure, (b) a floor section extending outward and downward from a lower edge of said base section, said elongated hook pin joined perpendicularly to the upper surface of said floor section, and having a backwardly and upwardly curved upper section joined to said straight bottom section of said hook pin.

(c) a roof section extending outward from an upper edge of said base section, and (d) a tab section extending downwards from said roof section.

7. The collapsible awning support frame of claim 6 wherein said means for pivotably fastening said first end portion of said tension member to said second outer end of said thrust member comprises;

(a) parallel, vertically disposed side strips extending longitudinally outwards along either side of said outer end of said thrust member, said side strips containing registered, transversely disposed apertures, (b) an aperture transversely disposed through said tension member, near said end portion of said tension member, and (c) an elongated pivot pin adapted to fit through said aperture on said thrust member and said aperture through said tension member, whereby said tension member may be positioned between said side strips and said pin inserted through said apertures through said strips and said aperture through said tension member.

8. The collapsible awning support frame of claim 6 whereby said means for fastening said first, inner end of said thrust member to a structure comprises;

(a) a clevis having a base plate adapted to fasten to the wall of a structure, and parallel horizontally disposed channel plates extending perpendicularly outwards from said base plate, each of said channel plates having a vertically registered hole, (b) a vertically disposed aperture passing through upper and lower sides of said thrust bar, near said first, inner end of said thrust bar, and (c) an elongated clevis pin adapted to fit down through said vertically registered holes in said channel plates and through said aperture through said thrust member, whereby said thrust member may be positioned between said channel plates and said clevis pin inserted downwards through said holes in said channel plates and said aperture through said thrust member.

9. A bracket for supporting the tension member of an awning support frame comprising;

(a) a base section having means for fastening said base section to a structure, (b) a floor section extending outwards and downwards from a lower portion of said base section, (c) an elongated hook pin joined perpendicularly to the upper surface of said floor section, and having a backwardly and upwardly curved upper section joined to said straight bottom section of said hook pin, (d) a roof section extending outward from an upper portion of said base section, and (e) a tab section extending downwards from said roof section, the lower edge of said tab being spaced apart from the plane of said floor section sufficiently far to permit insertion of an elongated tension member between said lower edge of said tab section and the upper surface of said floor section and the upper edge of said hook pin, thereby permitting said hook pin to engage said tension member.

* * * * *